US011235957B2

(12) United States Patent
Galerne et al.

(10) Patent No.: US 11,235,957 B2
(45) Date of Patent: Feb. 1, 2022

(54) MOTION ARRESTING AND DAMPENING DEVICE

(71) Applicant: Oceaneering International, Inc., Houston, TX (US)

(72) Inventors: Eric H Galerne, Houston, TX (US); Miles Roden, Houston, TX (US); Nat Spencer, Houston, TX (US)

(73) Assignee: Oceaneering International, Inc., Houston, TX (US)

( * ) Notice: Subject to any disclaimer, the term of this patent is extended or adjusted under 35 U.S.C. 154(b) by 11 days.

(21) Appl. No.: 16/926,240

(22) Filed: Jul. 10, 2020

(65) Prior Publication Data

US 2021/0053799 A1 Feb. 25, 2021

Related U.S. Application Data

(60) Provisional application No. 62/890,712, filed on Aug. 23, 2019.

(51) Int. Cl.

| | |
|---|---|
| ***B66C 13/06*** | (2006.01) |
| ***B66C 1/56*** | (2006.01) |
| ***B66C 1/46*** | (2006.01) |
| ***B66C 23/53*** | (2006.01) |

(52) U.S. Cl.

CPC ..... *B66C 13/063* (2013.01); *B66C 23/53* (2013.01); *B66C 1/46* (2013.01); *B66C 1/56* (2013.01)

(58) Field of Classification Search

CPC ..... B66C 13/04; B66C 13/06; B66C 13/063; B66C 13/08; B66C 13/18; B66C 13/46; B66C 23/06; B66C 23/52; B66C 23/62; B66C 23/82; B66C 1/46; B66C 1/56

See application file for complete search history.

(56) References Cited

U.S. PATENT DOCUMENTS

| | | | | | |
|---|---|---|---|---|---|
| 4,932,541 | A * | 6/1990 | Belsterling | B66C 13/02 | 212/271 |
| 5,152,408 | A * | 10/1992 | Tax | B66C 13/063 | 212/270 |
| 2010/0089855 | A1* | 4/2010 | Kjolseth | B66C 13/04 | 212/276 |
| 2011/0163057 | A1* | 7/2011 | Bjorshol | B66C 23/54 | 212/272 |
| 2014/0150232 | A1* | 6/2014 | Arthur | B66C 23/00 | 29/402.08 |

(Continued)

*Primary Examiner* — Michael R Mansen
*Assistant Examiner* — Juan J Campos, Jr.
(74) *Attorney, Agent, or Firm* — Maze IP Law, P.C.

(57) ABSTRACT

In embodiments, motion may be arrested and/or dampened using a motion arresting and dampening device comprising a lifting spreader bar, one or more bar mounted winches, deployment wire, a restorative inflation device, restraining wires and winches, hoses and controller, mechanical connection release system circuitry. Multiple restraints from winches mounted strategically on a vessel crane's boom may be applied to the spreader bar to restrain the bar during the lifting operation. The forces induced into the lifted object by the movement of the crane as it deploys the object into installation position are attenuated by the physical restrain of the adjustable wires. These adjustable wires may also be used to provide rotation of the object during final alignment of the object during installation.

19 Claims, 3 Drawing Sheets

(56) References Cited

U.S. PATENT DOCUMENTS

| | | | | |
|---|---|---|---|---|
| 2014/0169928 | A1* | 6/2014 | Lundman | B66C 1/56 414/800 |
| 2014/0263142 | A1* | 9/2014 | Billiot | B66D 1/50 212/272 |
| 2015/0110582 | A1* | 4/2015 | Jacobsen | B63B 27/10 414/141.6 |
| 2016/0152451 | A1* | 6/2016 | Vestre | B66D 1/08 212/291 |
| 2018/0339888 | A1* | 11/2018 | Staudecker | B66C 13/063 |
| 2019/0054982 | A1* | 2/2019 | Hansen | B63G 8/001 |

* cited by examiner

MOTION ARRESTING AND DAMPENING DEVICE

RELATION TO OTHER APPLICATIONS

This application claims priority through U.S. Provisional Application 62/890,712 filed on Aug. 23, 2019.

BACKGROUND

Offshore crane operations, such as those performed on or from floating vessels at sea, are plagued by a lifted object's oscillations a result of the vessel's pitching and rolling which displaces a crane wire's equilibrium pivot point, at the boom tip sheave, in relation to the lifted object's center of gravity, which results in a restoring force due to gravity acting on the object's mass, causing it to oscillate around the pivot point as it seeks to reestablish equilibrium. As the object swings, inertia is built in direct relation to its mass, the length of the pendulum, and the angular displacement from equilibrium. Inertia causes the lifted object to overshot equilibrium and it tends to oscillate about the equilibrium position, swinging back and forth, uncontrollably.

Since the seas are a continuous stream of influence to the vessel's motion, the induced object motion will continue to build in amplitude despite the effects of air resistance. Harmonic divergence between the vessel motion and that which the object exhibits further complicates the objects motions in all three axis and the more chaotic and uncontrollable the object becomes and the less likely the object can be safely landed and transferred to a fixed platform.

Successful installations from floating vessels to fixed structures require a twofold approach whereby motion of the object is minimized to begin with and secondarily, critical dampening is applied to arrest any motion just prior to landing the object.

FIGURES

Various figures are included herein which illustrate aspects of embodiments of the disclosed inventions.

Figure 3:
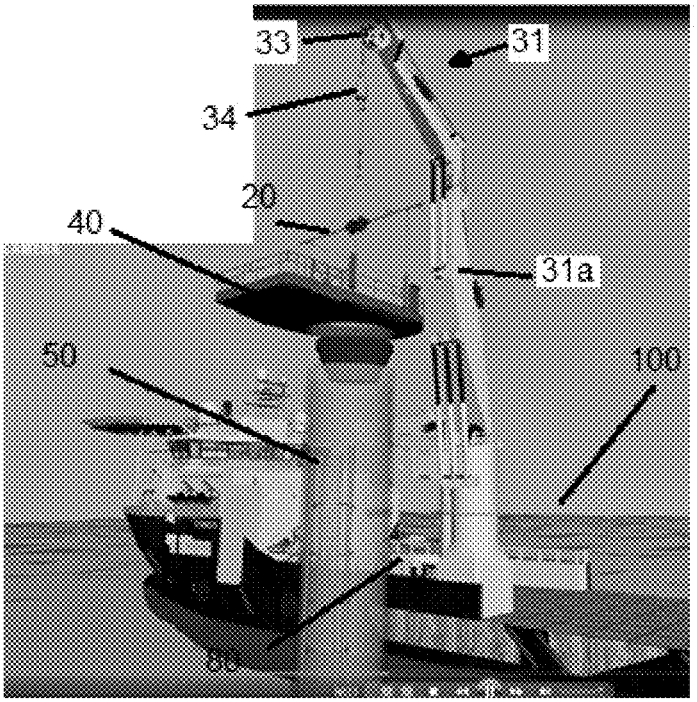
Figure 4:
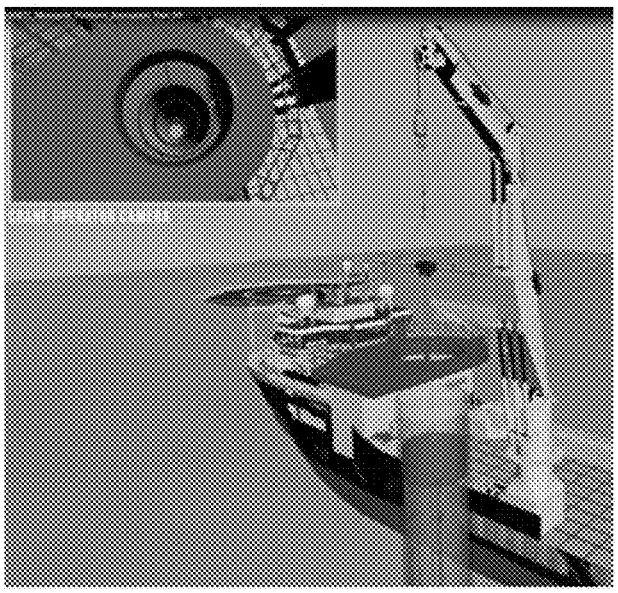
Figure 5:
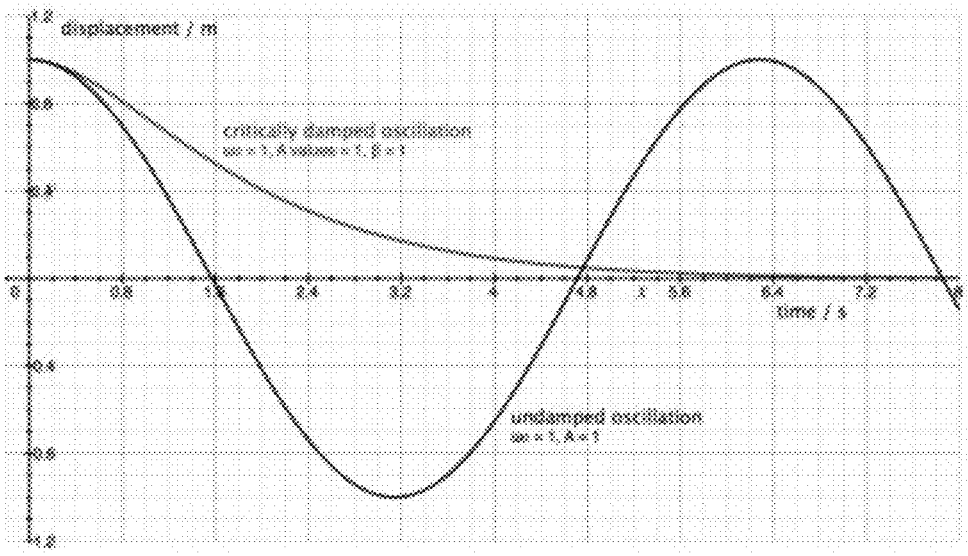

FIG. 3 illustrates a second view in partial perspective of an exemplary embodiment of a disclosed motion arresting and dampening device showing deployment on a vessel; and FIG. 4 illustrates a view in partial perspective of an exemplary embodiment of a disclosed motion arresting and dampening device showing deployment on a vessel and a view from a camera sensor that is part of the claimed motion arresting and dampening device;

FIG. 5 is a graphical representation of damped oscillation which can be achieved using the disclosed motion arresting and dampening device.

DESCRIPTION OF EXEMPLARY EMBODIMENTS

As used herein, a "critically dampened system" is one in which the dampening is designed to return the object back to equilibrium within one cycle, as illustrated in FIG. 5.

Figure 1:
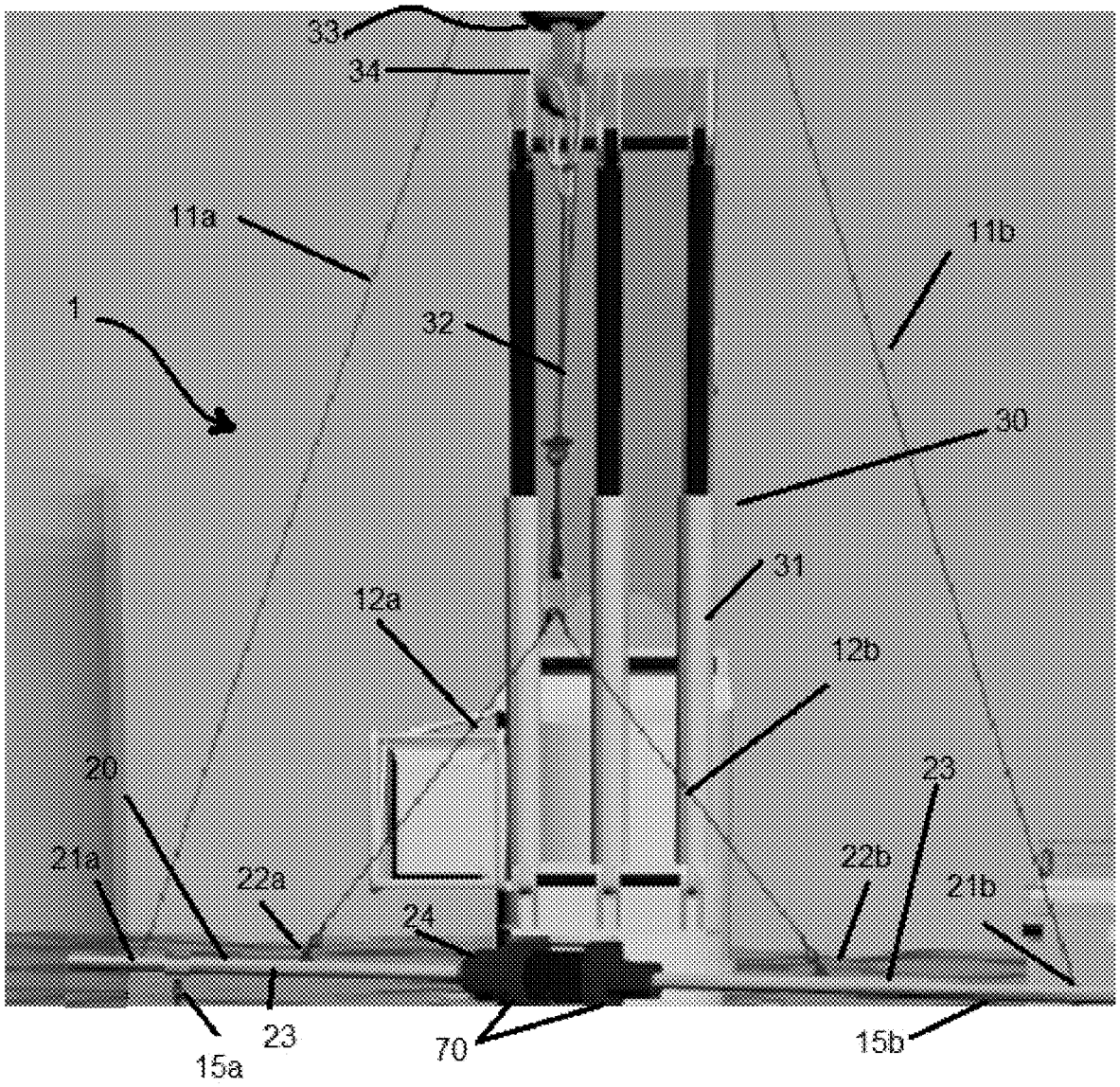
FIG. 1 illustrates a view in partial perspective of an exemplary embodiment of a disclosed motion arresting and dampening device.
Figure 2:
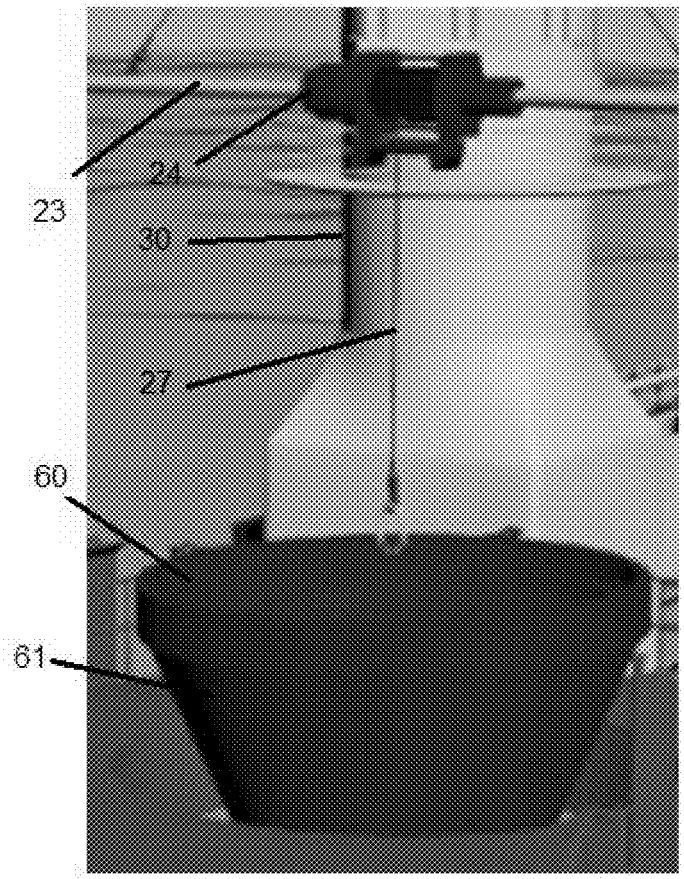
FIG. 2 illustrates a view in partial perspective of a portion of an exemplary embodiment of a disclosed motion arresting and dampening device.

In a first embodiment, referring generally to FIG. 1, FIG. 2, and FIG. 3, motion arresting and dampening device 1 comprises damper 60 (FIG. 2) dimensioned to fit a predetermined dimension of tubular 50 (FIG. 4); lifting spreader bar deployment assembly 20; lift 30 (FIG. 2); damper support 71 (not specifically called out in the figures); and a set of hoses and controller 80 (FIG. 3) which are operative to allow activation of winches, e.g. 33, and bladders, e.g. 61 (FIG. 2), as needed.

In most embodiments, lifting spreader bar deployment assembly 20 comprises lifting spreader bar 23; a set of object connector connection receivers 15*a*,15*b*; a set of lifting connector receivers 21*a*,21*b* disposed about lifting spreader bar 23 at a first offset from a center of lifting spreader bar 23; a set of lifting connectors 11*a*,11*b* operatively connected to the set of lifting connector receivers 21*a*,21*b*; a set of restraining connector receivers 22*a*,22*b* disposed about lifting spreader bar 23 at a second offset from a center of lifting spreader bar 23; and a set of adjustable restraining connectors 12*a*,12*b* operatively connected to the set of restraining connector receivers 22*a*,22*b*. In embodiments, the set of lifting connectors 11*a*,11*b* comprises one or more first lifting wires; the set of adjustable restraining connectors 12*a*,12*b* comprises one or more second lifting wires; lifting connector 32 comprises one or more third lifting wires; and deployment connector 27 (FIG. 2) comprises one or more fourth lifting wires; each of these lifting wires (also known as "downlines") connected to lifting spreader bar 23.

In embodiments, the set of adjustable restraining connectors 12*a*,12*b* comprises the second lifting wires may comprise first restraining wires operatively connected to lifting winch 33 and to first corresponding lifting connector connection receiver 22*a* of the set of lifting connector connection receivers 22*a*,22*b* and second restraining wires operatively connected to lifting winch 33 and second corresponding lifting connector connection receiver 22*b* of the set of lifting connector connection receivers 22*a*,22*b*. These first restraining wires and second restraining wires may further be operatively connected to lifting winch 33 via an intermediary connection such as lifting connector 32 and connector 34.

In embodiments, the set of lifting connector receivers 21*a*,22*b* comprises first lifting connector receiver 21*a*, disposed about lifting spreader bar 23 at a first offset from a center of lifting spreader bar 23, and second lifting connector receiver 21*b*, disposed about lifting spreader bar 23 at a second offset from the center of lifting spreader bar 23 distally opposite the first offset.

In embodiments, the set of restraining connector receivers 22*a*,22*b* comprises first restraining connector receiver 22*a*, disposed about lifting spreader bar 23 at a third offset intermediate the center of lifting spreader bar 23 and the first offset, and second restraining connector receiver 22*b*, disposed about lifting spreader bar 23 at a fourth offset intermediate the center of lifting spreader bar 23 and the second offset.

Referring still to FIG. 1 and FIG. 3, lift 30 (FIG. 2) typically comprises crane 31; lifting connector 32 operatively connected to the set of adjustable restraining connectors 12*a*,12*b*; and lifting winch 33 operatively connected to lifting connector 32 and to crane 31. Crane 31 may comprise vessel mounted crane 31*a* (FIG. 3) to which lifting winch 33 is operatively connected. In this embodiment, the set of adjustable restraining connectors 12*a*,12*b* typically comprises set of adjustable restraining connectors 12*a*,12*b* operatively connected to vessel mounted crane 31*a*.

Referring now additionally to FIG. 2, damper 60 typically comprises inflatable restorative inflation device 61. In an embodiment, the predetermined tubular dimension typically comprises an interior of tubular 50 and inflatable restorative inflation device 61 comprises an inflatable bag or an inflatable ring dimensioned to fit within the interior of tubular 50. In an alternative embodiment, the tubular dimension comprises an exterior of tubular 50 and inflatable restorative inflation device 61 comprises an inflatable bag or an inflatable ring dimensioned to fit about the exterior of tubular 50.

Damper support 71 (not specifically called out in the drawings) typically comprises deployment connector 27, operatively connected to damper 60, and bar mounted winch 24 disposed about a predetermined portion of lifting spreader bar 23, proximate a center of lifting spreader bar 23, and operatively connected to deployment connector 27.

In contemplated embodiments, controller 80 (FIG. 4) comprises a mechanical connection release system circuit.

In contemplated embodiments, one or more sensors 70 (FIG. 1) may be operatively in communication to controller 80 (FIG. 3), where sensors 70 may comprise an inclinometer, a potentiometer, an accelerometer, a camera (see, e.g., FIG. 4 illustrating a view from a camera), a taut wire sensor, or the like, or a combination thereof (each of which is referred to herein without a separate callout as each is a type of sensor 70).

In the operation of exemplary methods, referring back to FIG. 1 and to FIG. 5, motion may be arrested and dampened using motion arresting and dampening device 1 as described herein by attaching object 40 which may comprise a platform or the like, to lifting spreader bar assembly 20, positioning object 40 above tubular 50 (FIG. 4); operatively connecting the set of adjustable restraining connectors 12*a*, 12*b* to lifting winch 33 mounted on crane 31 and to lifting spreader bar 23 to restrain movement of lifting spreader bar 23 during a lifting operation; positioning damper 60 about a predetermined portion of tubular 50; inflating damper 60 to engage tubular 50; inducing forces into tubular 50 by movement of crane 31 as it deploys 50 tubular into an installation position; attenuating the induced forces by adjusting the set of adjustable restraining connectors 12*a*, 12*b* to physically restrain movement of tubular 50; and using the set of adjustable restraining connectors 12*a*,12*b* to rotate tubular 50 during alignment of tubular 50 during installation. Tubular 50 may comprise an installation mono-pile.

In most embodiments, referring additionally to FIG. 3 and FIG. 4, object 40, which may comprise a platform or the like, may be guided about a position of tubular 50 visually by an operator using camera 70. In alternate embodiments, a position of tubular 50 may be guided automatically under the control of taut wire sensor 70 mounted on or otherwise attached to motion arresting and dampening device 1 or to a load comprising object 40 and/or tubular 50, once the motion arresting and dampening device 1 has been set and one or more wires tensioned. Using taut wire sensor 70, verticality may be sensed such as by an inclinometer with respect to a vertical offset of object 40 and/or tubular 50 or by a potentiometer with respect to lifting spreader bar 23 and data from taut wire sensor 70 fed to controller 80 of crane 31 to make adjustments to the position of a boom that is part of lift 30 in three-dimensional ("3D") space to align the X, Y and Z axis of motion arresting and dampening device 1 with that of object 40 and/or tubular 50.

Damper 60 may be supported by using lifting spreader bar deployment assembly 20 and creating a temporary connection point between lifting spreader bar 23 and a center of tubular 50. In embodiments, dampening returns tubular 50 back to an equilibrium point within one cycle.

As described above, in an embodiment restorative inflation device 61 comprises an inflatable restorative bladder or an internal circumferential restorative inflation ring. In such embodiments, inflating damper 60 to engage tubular 50 typically further comprises inserting restorative inflation device 61 into an annulus of tubular 50 to create a temporary friction connection between restorative inflation device 61 and an interior portion of the annulus of tubular 50 and providing a fixed point in a horizontal plane defined by object 40 and/or tubular 40 from which a restorative force can be applied to lifting wires, e.g. lifting connectors 11*a*, 11*b* and/or restraining connectors 12*a*,12*b*.

As also described above, in alternate embodiments restorative inflation device 61 further comprises an inflation ring. In such embodiments, the inflation ring is typically positioned about an outer circumference of tubular 50 and inflated to engage the outer circumference of tubular 50, establishing a fixed point on the outer circumference of tubular 50.

In either of these two embodiments, inflation may be accomplished using compressed gas or fluid.

In contemplated embodiments, restorative inflation device 61 may be deflated and retrieved back to lifting spreader bar 23. Mechanical connections securing object 40 may be released and motion arresting and dampening device 1 lifted and retrieved back to floating vessel 100. Releasing the mechanical connections securing the object may occur remotely.

Additionally, a restorative force may be controlled by applying constant or adjustable winch tension via lifting wires; allowing payout and pull-in of the lifting wires which can be adjusted to set motion arresting and dampening device 1 in place; and after inflation, selectively increasing or decreasing the righting and securing force applied to a load created or otherwise present with respect to object 40 or tubular 50.

The foregoing disclosure and description of the inventions are illustrative and explanatory. Various changes in the size, shape, and materials, as well as in the details of the illustrative construction and/or an illustrative method may be made without departing from the spirit of the invention.

The invention claimed is:

1. A motion arresting and dampening device, comprising:

a. a damper dimensioned to fit a predetermined tubular dimension of a tubular, the damper comprising an inflatable restorative inflation device;

b. a lifting spreader bar deployment assembly, comprising:

i. a lifting spreader bar;

ii. a set of object connector connection receivers;

iii. a set of lifting connector receivers disposed about the lifting spreader bar at a first offset from a center of the lifting spreader bar;

iv. a set of lifting connectors operatively connected to the set of lifting connector receivers;

v. a set of restraining connector receivers disposed about the lifting spreader bar at a second offset from the center of the lifting spreader bar; and vi. a set of adjustable restraining connectors operatively connected to the set of restraining connector receivers;

c. a lift, comprising:

i. a crane;

ii. a lifting connector operatively connected to the set of adjustable restraining connectors; and iii. a lifting winch operatively connected to the lifting connector (32) and to the crane;

d. a damper support, comprising:

i. a deployment connector operatively connected to the damper (60); and ii. a bar mounted winch disposed about a predetermined portion of the lifting spreader bar and operatively connected to the deployment connector;

e. a predetermined set of winch and bladder activation hoses operatively in communication with the winches and bladders; and f. a controller disposed proximate the lift and operatively in communication with the predetermined set of winch and bladder activation hoses.

2. The motion arresting and dampening device of claim 1, wherein the controller comprises a mechanical connection release operatively in communication with the damper.

3. The motion arresting and dampening device of claim 1, wherein:

a. the tubular dimension comprises an interior of the tubular and the inflatable restorative inflation device comprises an inflatable bag or an inflatable ring dimensioned to fit within an interior of the tubular; or b. the tubular dimension comprises an exterior of the tubular and the inflatable restorative inflation device comprises an inflatable bag or an inflatable ring dimensioned to fit about an exterior of the tubular.

4. The motion arresting and dampening device of claim 1, wherein:

a. the set of lifting connector receivers comprises:

i. a first lifting connector receiver disposed about the lifting spreader bar at a first offset from a center of the lifting spreader bar; and ii. a second lifting connector receiver disposed about the lifting spreader bar at a second offset from the center of the lifting spreader bar distally opposite the first offset; and b. the set of restraining connector receivers comprises:

i. a first restraining connector receiver disposed about the lifting spreader bar at a third offset intermediate the center of the lifting spreader bar and the first offset; and ii. a second restraining connector receiver disposed about the lifting spreader bar at a fourth offset intermediate the center of the lifting spreader bar and the second offset.

5. The motion arresting and dampening device of claim 1, wherein the set of adjustable restraining connectors comprises:

a. a first restraining wire operatively connected to the lifting winch and to a first corresponding lifting connector connection receiver of the set of lifting connector connection receivers; and b. a second restraining wire operatively connected to the lifting wince, the first restraining wire, and a second corresponding lifting connector connection receiver of the set of lifting connector connection receivers.

6. The motion arresting and dampening device of claim 1, wherein:

a. the crane comprises a vessel mounted crane to which the lifting winch is operatively connected; and b. the set of adjustable restraining connectors comprises set of adjustable restraining connectors operatively connected to the vessel mounted crane.

7. The motion arresting and dampening device of claim 1, further comprising a sensor operatively in communication with the controller.

8. The motion arresting and dampening device of claim 1, wherein:

a. the set of lifting connectors comprises a first lifting wire;

b. the set of adjustable restraining connectors comprises a second lifting wire;

c. the lifting connector comprises a third lifting wire; and d. the deployment connector comprises fourth lifting wire.

9. A method of arresting and dampening motion using a motion arresting and dampening device comprising a damper that comprises an inflatable restorative inflation device dimensioned to fit a predetermined tubular dimension; a lifting spreader bar deployment assembly comprising a lifting spreader bar, a set of object connector connection receivers, a set of lifting connector receivers disposed about the lifting spreader bar at a first offset from a center of the lifting spreader bar, a set of lifting connectors operatively connected to the set of lifting connector receivers, a set of restraining connector receivers disposed about the lifting spreader bar at a second offset from a center of the lifting spreader bar, and a set of adjustable restraining connectors operatively connected to the set of restraining connector receivers; a lift comprising a crane, a lifting connector operatively connected to the set of adjustable restraining connectors, and a lifting winch operatively connected to the lifting connector and to the crane; a damper support comprising a deployment connector operatively connected to the damper and a bar mounted winch disposed about a predetermined portion of the lifting spreader bar and operatively connected to the deployment connector; a predetermined set of winch and bladder activation hoses; and a controller; the method comprising:

a. attaching an object to the lifting spreader bar assembly;

b. positioning the object above a tubular;

c. operatively connecting the set of adjustable restraining connectors to the lifting winch mounted on the crane and to the lifting spreader bar to restrain movement of the lifting spreader bar during a lifting operation;

d. positioning the damper about a predetermined portion of the tubular;

e. inflating the damper to engage the tubular;

f. inducing forces into the tubular by movement of the crane as it deploys the tubular into an installation position;

g. attenuating the induced forces by adjusting the set of adjustable restraining connectors to physically restrain movement of the tubular; and h. using the set of adjustable restraining connectors to rotate the tubular during alignment of the tubular during installation.

10. The method of claim 9, further comprising:

a. supporting the damper using the lifting spreader bar deployment assembly; and b. creating a temporary connection point between the spreader bar and a center of the tubular.

11. The method of claim 9, wherein the tubular comprises an installation mono-pile.

12. The method of claim 9, wherein:

a. the restorative inflation device comprises an inflatable restorative bladder or an internal circumferential restorative inflation ring; and b. inflating the damper to engage the tubular further comprises:

i. inserting the restorative inflation device into the annulus of the tubular to create a temporary friction connection between the restorative inflation device and an interior portion of an annulus of the tubular; and ii. providing a fixed point in a horizontal plane defined by an axis of the tubular from which a restorative force can be applied to the lifting wire.

13. The method of claim 9, wherein the restorative inflation device further comprises an inflation ring, the method further comprising:

a. positioning the inflation ring about an outer circumference of the tubular;

b. inflating the inflation ring to engage the outer circumference of the tubular; and c. establishing a fixed point on the outer circumference of the tubular.

14. The method of claim 9, wherein the lifting connector comprises multiple downlines connected to the lifting spreader bar.

15. The method of claim 9, wherein the dampening returns the tubular back to an equilibrium point within one cycle.

16. The method of claim 9, further comprising:

a. using winch tension to control a restorative force;

b. allowing payout and pull-in of a lifting wire which can be adjusted to set the motion arresting and dampening device in place; and c. after inflation, selectively increasing or decreasing the righting and securing force applied to a load comprising the tubular.

17. The method of claim 9, wherein inflation is achieved via compressed gas or fluid.

18. The method of claim 9, further comprising guiding a position of the tubular automatically under the control of a taut wire sensor mounted on the motion arresting and dampening device or a load comprising the object, once the motion arresting and dampening device has been set and wire tensioned, by sensing a verticality either by inclinometer with respect to the vertical or by potentiometer with respect to the spreader bar and this data is fed to the crane's control system to make adjustments to the boom's position in 3D space to align the X, Y and Z axis.

19. The method of claim 9, further comprising:

a. deflating the restorative inflation device;

b. retrieving the restorative inflation device back to the spreader bar;

c. releasing the mechanical connections securing the object;

d. lifting the entire assembly; and e. retrieving the assembly back to the floating vessel.

* * * * *